US006374794B1

(12) United States Patent
Dudemaine

(10) Patent No.: US 6,374,794 B1
(45) Date of Patent: Apr. 23, 2002

(54) POWER UNIT INCLUDING AN OIL PAN SEPARATION PIECE

(75) Inventor: Jean-Pierre Dudemaine, Les Echets (FR)

(73) Assignee: Renault Vehicules Industriels, Lyons (FR)

( * ) Notice: Subject to any disclaimer, the term of this patent is extended or adjusted under 35 U.S.C. 154(b) by 0 days.

(21) Appl. No.: 09/621,866

(22) Filed: Jul. 21, 2000

(30) Foreign Application Priority Data

Jul. 21, 1999 (FR) ..... 99 09438

(51) Int. Cl.[7] ..... F02F 7/00
(52) U.S. Cl. ..... 123/195 H
(58) Field of Search ..... 123/195 R, 195 A, 123/195 C, 196 R; 184/106

(56) References Cited

U.S. PATENT DOCUMENTS 2,837,063 A * 6/1958 Martinez ..... 184/106
3,100,028 A * 8/1963 Booth et al. ..... 123/196 R
4,245,595 A 1/1981 Abe et al.
4,294,333 A * 10/1981 Little ..... 184/106
4,465,041 A * 8/1984 Hayashi ..... 123/195 R
4,766,858 A * 8/1988 Yoshidome et al. .... 123/195 R
4,770,276 A 9/1988 Takubo
5,469,822 A * 11/1995 Meschsner ..... 123/195 R
5,852,991 A * 12/1998 Yamamura et al. ..... 123/195 C

FOREIGN PATENT DOCUMENTS

| | | |
|---|---|---|
| EP | 0 368 478 | 5/1990 |
| FR | 2.171.539 | 9/1973 |
| GB | 2 235 725 | 3/1991 |

* cited by examiner

*Primary Examiner*—Marguerite McMahon
(74) *Attorney, Agent, or Firm*—Oblon, Spivak, McClelland, Maier & Neustadt, P.C.

(57) ABSTRACT

An assembly for a power plant for a motor vehicle which includes longitudinally, from front to rear, a thermal engine and a transmission wherein the rear side of a longitudinal block of the thermal engine is rigidly connected to the front side of a housing of the transmission, especially a housing for a flywheel, that includes, to the right of a plane of attachment of an oil pan beneath the block of the engine, two horizontal right angle members, facing one another transversely, each one including a longitudinal front first arm secured rigidly to the engine block, and a second transverse rear arm secured rigidly to the housing in order to strengthen the assembly of the engine and of the transmission. The assembly includes a separation piece which is inserted vertically between the engine block and the oil pan, and on which the first forward arms of the two right angles are rigidly attached.

5 Claims, 2 Drawing Sheets

POWER UNIT INCLUDING AN OIL PAN SEPARATION PIECE

BACKGROUND OF THE INVENTION

1. Field of the Invention

The invention pertains to a power unit for a passenger vehicle and, more particularly, to a power unit for a passenger vehicle that includes, longitudinally from front to rear, a thermal engine and a transmission, of a kind in which the rear side of a longitudinal block of the thermal engine is rigidly connected to the front side of the transmission housing, especially a housing for an engine flywheel, the housing being of the kind which includes, to the right of the oil pan installation plane beneath the engine block, two horizontal right angle members, facing one another transversely, each one including a longitudinal forward arm secured rigidly to the engine block, and a second rear transverse mounted arm secured rigidly to the transmission housing to strengthen the assembly connection of the power unit and transmission.

2. Discussion of the Background the Invention

Many examples of power plants are known. The object of concern here, for the most part, is with power plant units in which the thermal engine is a powerful engine and in which the output shaft, made as one piece with the crankshaft, is capable of driving the transmission with considerable torque. During operation, due to the vibrations to which the engine is subjected and, more generally, the power plant in its entirety, the attachment points of the engine block to the transmission crank case are subjected to longitudinal bending stresses.

Elsewhere it has also been found that due to the friction that exists between the different bearings of the crankshaft and the output shaft, one part of the engine torque is capable of being partially transmitted, especially during restarts of the engine, to the thermal engine, unit in the form of a torque about the direction of the output shaft of the engine, which has the effect of producing shear stresses on the attachment points of the engine block to the transmission housing, and of causing torsional stresses for the transmission housing.

The attachment points of the engine block to the transmission housing are traditionally made in the form of screw-and-nut connections.

Due to the effect of bending stresses and stresses due to the engine torque that are partially transmitted to the block, these screws and nuts can become deformed, which can have the consequence of causing difficulties when, for example, one wishes to remove the vehicle engine by separating it from the transmission.

The deformation of these bearings can cause accelerated wear of the turning components that they carry as well as leakage of the lubricant.

SUMMARY OF THE INVENTION

In order to overcome this disadvantage, it has been suggested that one insert right angle members of the kind described previously between the engine block and one housing of the transmission crank case. This design allows one to strengthen in a satisfactory manner the connection between the engine block and the transmission crankcase, but it also presents many disadvantages.

In order to provide satisfactory attachment, the right angle members must have numerous anchoring points, which make it difficult to install and remove them, from the standpoint of the time one must spend on this operation and the positioning of the anchoring points before the installation.

In other respects, the large number of anchoring points will increase to the same extent the number of machine finishing steps that must be accomplished on the engine block and on the transmission crankcase housing, which increases the manufacturing costs of such an engine block and of the transmission crank case.

Finally, in order to offer sufficient resistance, these right angle members must be made of a material such as cast iron, which will make the power plant unit heavier.

In order to overcome these disadvantages, the present invention recommends right angle members that are integrated with one additional element of the engine block.

For this purpose, the inventions proposes a power plant of the kind described previously, characterized in that it includes a separation piece which is inserted vertically between the engine block and the oil pan, and on which the first arms are secured rigidly forward of the two right angle members.

This separation piece allows one advantageously to benefit from an increase of in the engine lubricating oil capacity and, depending upon the shape of the separation piece, to install different kinds of oil pan on the same engine block.

According to other characteristics of the invention:

(1) The oil pan separation piece has approximately the shape of a parallelepiped whose upper side is complementary to the shape of the periphery of the lower side of the engine block, and whose lower side is complementary to the shape of the periphery of the upper side of the oil pan, in order to allow the adjustment of an oil pan combined with the engine block.

(2) Each right angle member has the shape of a tetrahedron in which the base forms the second rear arm of the right angle, and in which the body forms the first arm of the right angle.

(3) Each tetrahedral right angle member includes, at the vertices of its base, which are most distant from the median axis of the engine, two longitudinal borings for attachment by screwing of the right angle on a complementary perforated surface of the transmission housing.

(4) The body of each right angle member includes a recess, which opens at its base in order to lighten and strengthen the right angle member.

(5) The right angle members are made of the same material as the separation piece.

(6) The separation pieced is obtained by molding, specifically of an aluminum alloy.

(7) The parallelepiped separation piece includes openings that open between its upper and lower sides to allow the passage of moving contact elements of the engine.

BRIEF DESCRIPTION OF THE DRAWINGS

Other characteristics and advantages of the invention will be apparent from reading the following detailed description, which will be further elucidated by referring to the attached figures, wherein.

DESCRIPTION OF THE PREFERRED EMBODIMENTS

In the description which follows, identical reference numbers designate elements that are identical or have similar functions.

Figure 1:
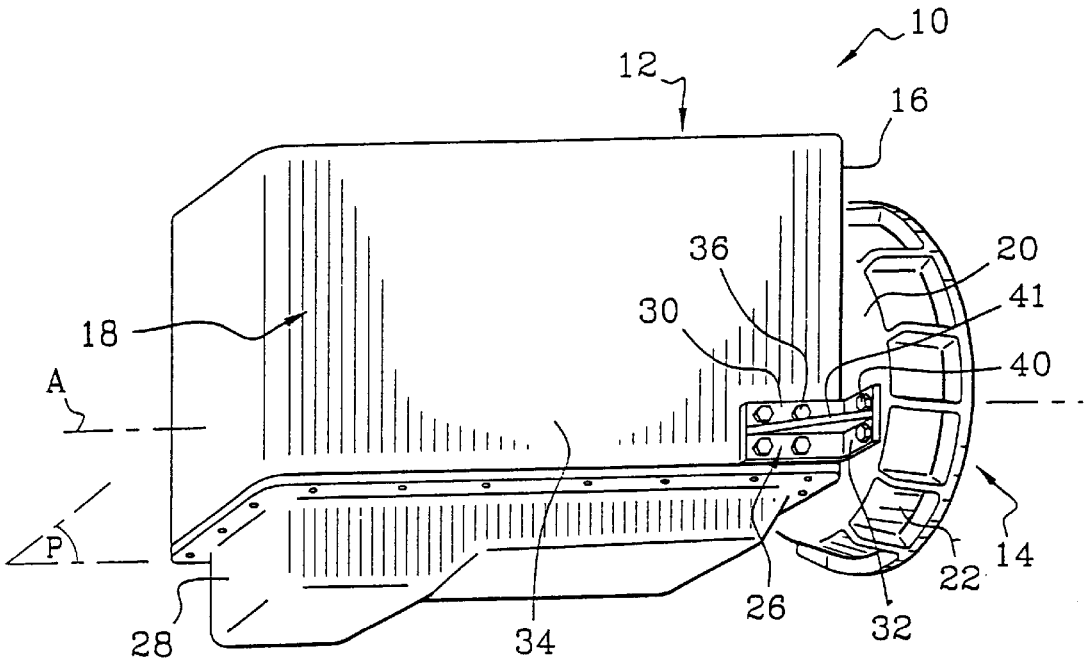
FIG.1 PRIOR ART
FIG. 1 is a partial perspective view of a power plant unit according to the prior art that includes right angles of independent connections.

In a non-limiting manner, and with reference to the figures, the terms horizontal, vertical, longitudinal, transverse, forward and rear are utilized. Shown in FIG. 1 is the entire power plant unit 10 for a passenger vehicle made in conformity with the state of the art.

In a known manner, the power plant unit 10 includes longitudinally, from front to rear, a thermal engine 12, which is connected to a transmission 14. The rear transverse side 16 of an engine block 18 is connected rigidly to the forward side 20 of a housing 22 of a case (not shown) for the transmission 14. The housing 22 is made especially of the same material as the housing of the transmission 14 and is designed to protect a flywheel and/or a clutch assembly (not shown) of the power plant unit 10.

In a known manner, the engine 12 includes a crankshaft (not shown), which is coupled to an output shaft with axis A for powering the transmission 14 of the vehicle.

When the engine of the vehicle is operating, the engine block 18 is subject to vibrations and is therefore capable of transmitting longitudinal bending stresses to the connection between the engine block 18 and the transmission housing 22.

In other cases when, during restarting of the engine 12 of the vehicle for example, the crankshaft is subject to considerable torque, such transmits a part of this torque to the engine block 18 of the engine 12 through the intermediary of the bearings which support it so that the block 18 is partially made to rotate about the axis A of the crankshaft and the output shaft of the engine 12. The connection of the engine block 18 to the housing 22 is then subjected to severe shear stresses, which is harmful to the power plant unit 10.

Thus, according to the known design of the state of the art, right angle members 26 have been provided that allow the assembly of the engine block 18 to the housing 22 to be strengthened.

With the engine block 18 assembled to the housing 22 by the intermediary of anchoring points such as screws and nuts (not shown) that are arranged regularly on the rear side of the block 16 of the engine 12, the means for attachment of the engine block 18 to the housing 22 do not extend below a plane P of attachment of an oil pan 28 of the power plant unit 10 beneath the engine 12.

The right angle members 26 are arranged approximately to the right of the plane P of attachment; that is, as low as possible with respect to the axis A of the crankshaft of the engine 12 in such a way as to ensure acceleration of the bending and shearing forces that are transmitted as they come from the block 18 of the engine 12. The power plant unit 10 includes two right angles facing one another 26, which are arranged in the plane P, on either side of the axis A of the crankshaft.

As shown in FIG. 1, the right angle members 26 have a horizontal orientation and each include a first forward longitudinal arm 30 which is secured to one part vis-à-vis the corresponding lateral side 34 of the block 18 of the engine 12, and a second rear transverse arm 32 which is attached to one part vis-a-vis the front side 20 of the housing 22 of the transmission 14.

The longitudinal first forward arm 30 has approximately the shape of a flat plate, which is bolted by means of screw 36 to the corresponding lateral side 34 of the engine block 18. The lateral side 34 of the engine block 18 is machined for this purpose in such a way as to make available a flat support surface for the first forward arm 30 of the right angle members 26.

In a similar manner, the second rear arm 32 is bolted by means of screw 40 on the front side 20 of the transmission housing 22, which is also machined in a suitable manner. Finally, a strengthening rib 41 connects the first forward arm 30 and the second rear arm 32 to one another.

Figure 2:
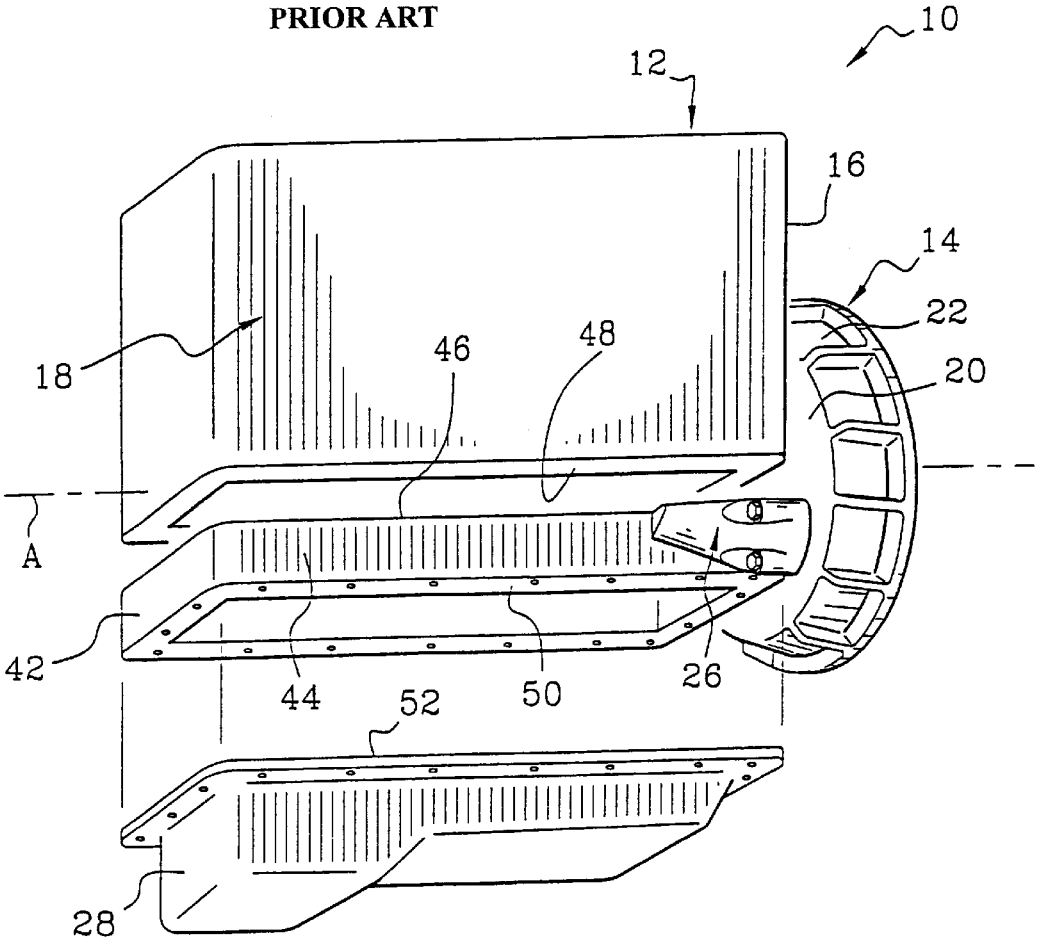
FIG. 2 is a partial perspective view of a power plant unit according to the prior art that includes a separation piece according to the invention; and, FIG. 3 is a partial perspective view of a separation piece according to the invention.

In conformity with the invention and as shown in FIG. 2, a separation piece 42, which includes right angle members 26, is placed between the block 18 of the engine 12 and the oil pan 28 of the engine 12.

In the preferred mode of implementation of the invention, the right angle members 26 are integrated with the separation piece 42, and are made of the same material as the latter.

This arrangement does not limit the invention, and the right angle members 26 can, in variants not shown here, be independent right angle members, which are attached in a manner similar to that described with respect to FIG. 1 on the lateral sides 44 of the separation piece 42. This arrangement allows one, specifically during assembly of the power plant group 10, to be able to assemble separately the engine block 18 and its fittings on the one hand, and the separation piece 42 and the right angles 26 on the other hand, which represents a time gain in the time required for assembly of the engine 12. During final assembly of the power plant group 12, one then only has to attach the second transverse rear arm 32 of the right angles 26 on the front side 20 of the housing 22 of the transmission 14.

However, maximum rigidity of the final assembly of the power plant group 10 and minimum installation time are obtained by making the separation piece 42 and the right angles 26 as a single piece.

In conformity with the invention, the separation piece 42 has approximately the shape of a parallelepiped of which one upper side 46 complements the shape of the periphery of a lower side 48 of the engine block 18, and of which the lower side 60 is complementary to the shape of the periphery of the upper side 52 of the oil pan 28.

In this arrangement, the separation piece 42 allows one advantageously to attach different kinds of oil pans 28 to the same engine block 18, so that in each case an oil pan 42 of the appropriate shape can be used. This arrangement allows one to appreciably lower the production costs of an engine 12 in the manufacturing cycle to the extent that it is not necessary to provide an engine block 18 that corresponds to each type of oil pan 28, and to the extent that a single standard engine block 18 can be fitted to various oil pans 28.

In addition, one can combine an oil pan 28 with an adequate shape and capacity for every engine 12, as a function of its power and its lubrication needs.

Figure 3:
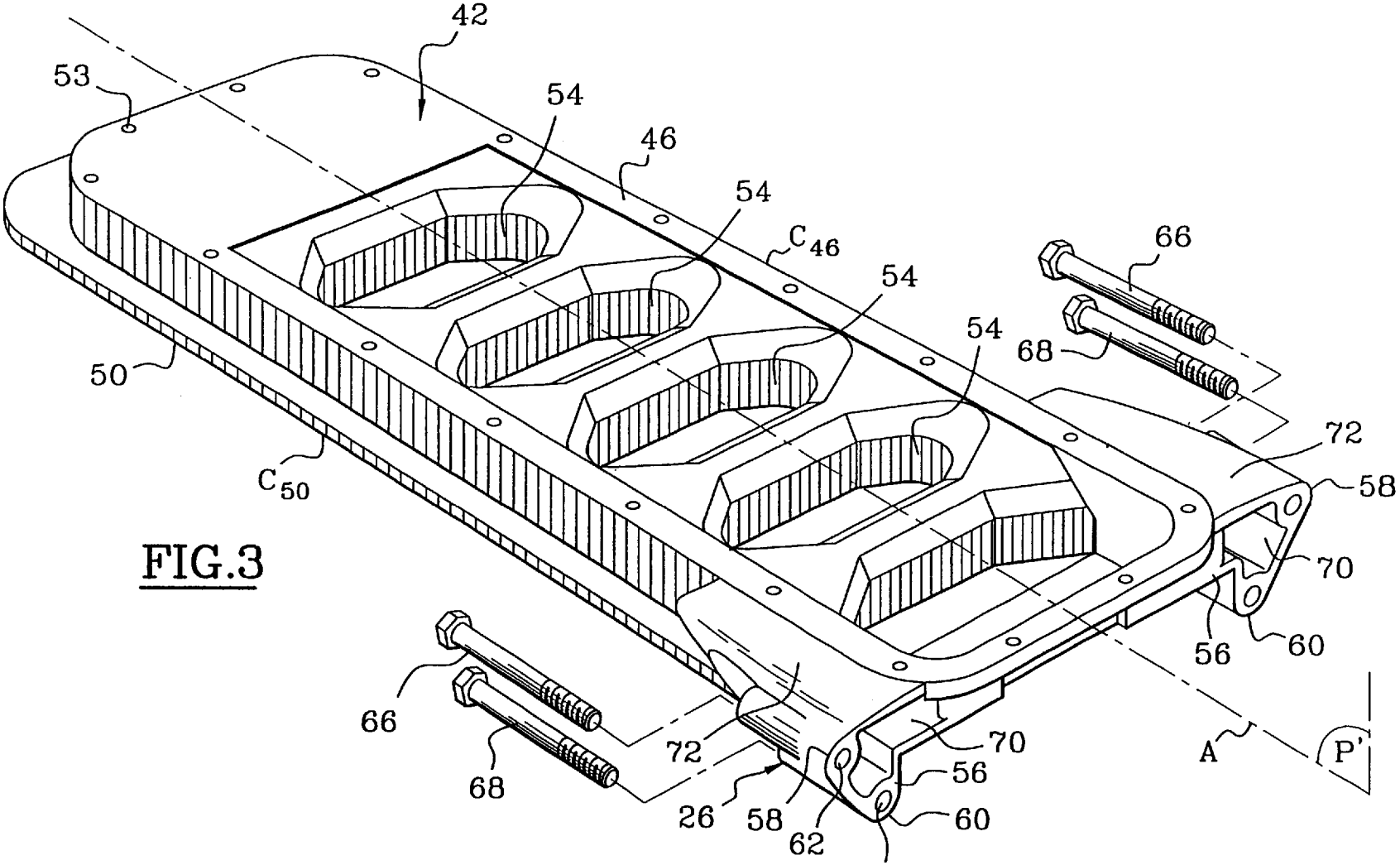

FIG. 3 shows the shapes of the oil pan 42 in greater detail. We have shown in particular the upper side 46, with contour $C_{46}$ that is complementary to the contour of the corresponding part of the lower side 48 of the engine block 18 described previously, and the lower side 50, with contour $C_{50}$ that is complementary to the contour of the corresponding part of the upper side 52 of the oil pan 28.

The upper and lower sides 46, 50 include borings 53 for attachment of the separation piece 42 to the engine block 18 and to the oil pan 28. The separation piece 42 is made in the shape of a parallelepiped cast from an aluminum alloy that includes openings 54 which open out between its upper 46 and lower 50 sides in order to permit the passage of components (not shown) of a moving contact of the engine 12, especially of equilibrium fly weights of a crankshaft of the engine 12 and a power distribution pulley of the engine 12.

In conformity with the invention, the right angle members 28 are made of the same material as the separation piece 42.

In the preferred mode of implementation of the invention, each of the right angle members 26 has the shape of a tetrahedron whose base 56 forms the second rear arm 32 of the right angle 26, and whose body 72 forms the first forward arm 30 of the right angle members 26.

The base 56 of each of the right angle members 26 includes, at its vertices 58 and 60 that are most distant from the median plane P', which is vertical and contains the axis A of the previously described crankshaft, longitudinal borings 62 and 64 being provided for attachment corresponding screws 66, of the right angle member 26 on a perforated and threaded surface (not shown) of the front side 20 of the housing 22. For this purpose, the base 56 of each right angle is machined in a manner to allow optimal plane adjustment of these two surfaces.

Finally, the body 72 of each right angle member 26 includes a recess 70 produced during casting of the separation piece 42, which allows one on the one hand to lighten the separation piece 42 and on the other hand to increase the resistance of the right angle member 26, since a hollow space is, given the same bending or twisting stress, more resistant than a solid space which carries the risk of cracking.

Thus, in an advantageous manner, the separation piece 42 allows one to strengthen the assembly of the engine 12 to the transmission 14, to simplify the installation of the right angle members 28 while decreasing the number of anchoring points that are employed, and allows one to increase the oil capacity of the engine 12 by attaching an oil pan 28 with appropriate volume, which allows one in particular, for presently used private vehicles, to lengthen the time interval between successive oil changes.

What is claimed is:

1. An oil pan separation assembly for a power plant unit for a motor vehicle that includes longitudinally, from front to rear, a thermal engine and a transmission in which a rear side of a longitudinal block of the thermal engine is rigidly connected to a forward side of a housing of the transmission which comprises:

two horizontal right angle members located in proximity with a plane of attachment of an oil pan beneath the block of the engine, said two horizontal right angles members facing one another transversely, each of said right angle members including a longitudinal front first arm rigidly attached to the engine block and a transverse rear second arm rigidly attached to the transmission to strengthen the engine assembly, wherein each right angle member comprises a tetrahedron-shaped right angle member having a base which forms said second arm of the right angle members, and which has a body forming the first arm of the right angle members; and a separation piece which is insertable vertically between the engine block and the oil pan, and on which the first arms of the two right angle members are secured wherein each of said tetrahedron-shaped right angle members includes, at vertices of the base most distant from a median plane of the engine, first and second longitudinal borings for attachment of the right angle members, to a complementary perforated surface of the transmission housing and wherein the body of each of said right angle members includes a recess which opens into the base so as to lighten and strengthen said right angle members.

2. An assembly according to claim 1 wherein the separation piece of the oil pan comprises a parallelepiped having an upper side which is complementary in shape with a contour of a lower side of the engine block, said separation piece having a lower side which is complementary in shape to a contour of an upper side of the oil pan, for permitting adjustably of the connection with the engine block.

3. An assembly according to claim 1 wherein the right angle members comprise the same material as the separation piece.

4. An assembly according to claim 1 wherein the separation piece comprises a cast piece made of an aluminum alloy.

5. An assembly according to claim 2 wherein the parallelepiped separation piece includes openings which open out between an upper and lower side thereof to allow passage of elements of a moving member of the engine.

* * * * *